United States Patent [19]

Paurat

[11] 4,231,618

[45] Nov. 4, 1980

[54] TUNNEL-EXCAVATING MACHINE

[76] Inventor: Friedrich W. Paurat, Nordstrasse 73, 4223 Voerde, Fed. Rep. of Germany

[21] Appl. No.: 857,191

[22] Filed: Dec. 2, 1977

[30] Foreign Application Priority Data

Mar. 12, 1977 [DE] Fed. Rep. of Germany ..... 2710960

[51] Int. Cl.[2] ..... E21C 25/68; E21C 25/06

[52] U.S. Cl. ..... 299/31; 299/33; 299/71

[58] Field of Search ..... 299/31, 33, 34, 11, 299/71, 85, 86; 173/162, 139; 267/124, 125, 137; 405/295-298; 403/224, 225

[56] References Cited

U.S. PATENT DOCUMENTS

| | | | |
|---|---|---|---|
| 1,195,396 | 8/1916 | Recen | 299/86 |
| 1,549,700 | 8/1925 | Wilson | 299/33 X |
| 3,199,903 | 8/1965 | Wood | 403/224 |
| 3,276,819 | 10/1966 | Lobbe et al. | 299/33 X |
| 3,419,311 | 12/1968 | Scaravilli et al. | 299/31 |
| 3,499,621 | 3/1970 | Boehringer et al. | 267/124 X |
| 3,847,438 | 11/1974 | Huttenbrauck et al. | 299/34 |
| 3,922,016 | 11/1975 | Tyslauk et al. | 299/31 |
| 3,968,843 | 7/1976 | Shotwell | 173/139 |
| 4,045,089 | 8/1977 | Hauschopp et al. | 299/43 |
| 4,095,845 | 6/1978 | Paurat | 299/46 |

FOREIGN PATENT DOCUMENTS

| | | | |
|---|---|---|---|
| 1165524 | 3/1964 | Fed. Rep. of Germany | 299/85 |

*Primary Examiner*—James A. Leppink
*Attorney, Agent, or Firm*—Karl F. Ross

[57] ABSTRACT

A tunnel-excavating machine in which a chassis carrying a cutting drum is displaceable toward the face of a subterranean structure in which a tunnel is to be formed, the chassis being provided independently from a roof-support unit which is connected to the chassis only by at least one fluid-pressure cylinder arrangement. The cylinder arrangement is connected to the unit and/or the chassis by vibration damping means so that the cylinder arrangement can advance the chassis relative to the roof support unit or vice versa and vibration transmission from the chassis to the roof support unit is damped.

6 Claims, 5 Drawing Figures

FIG. 1
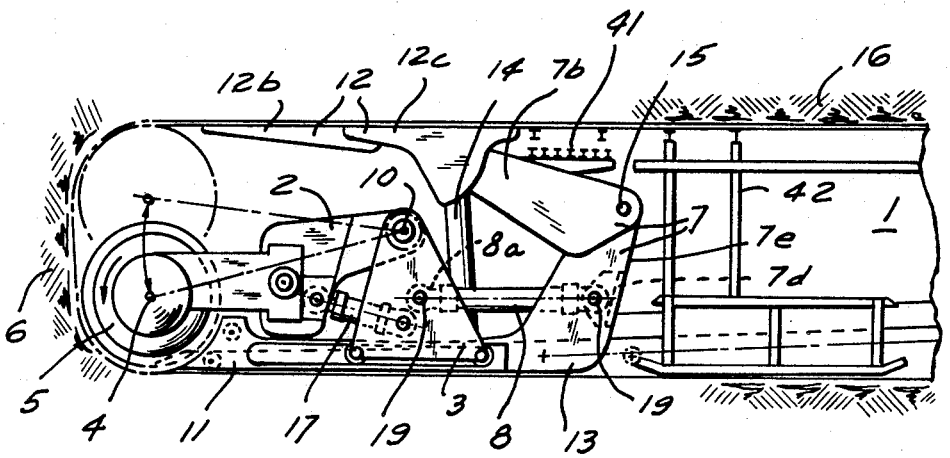
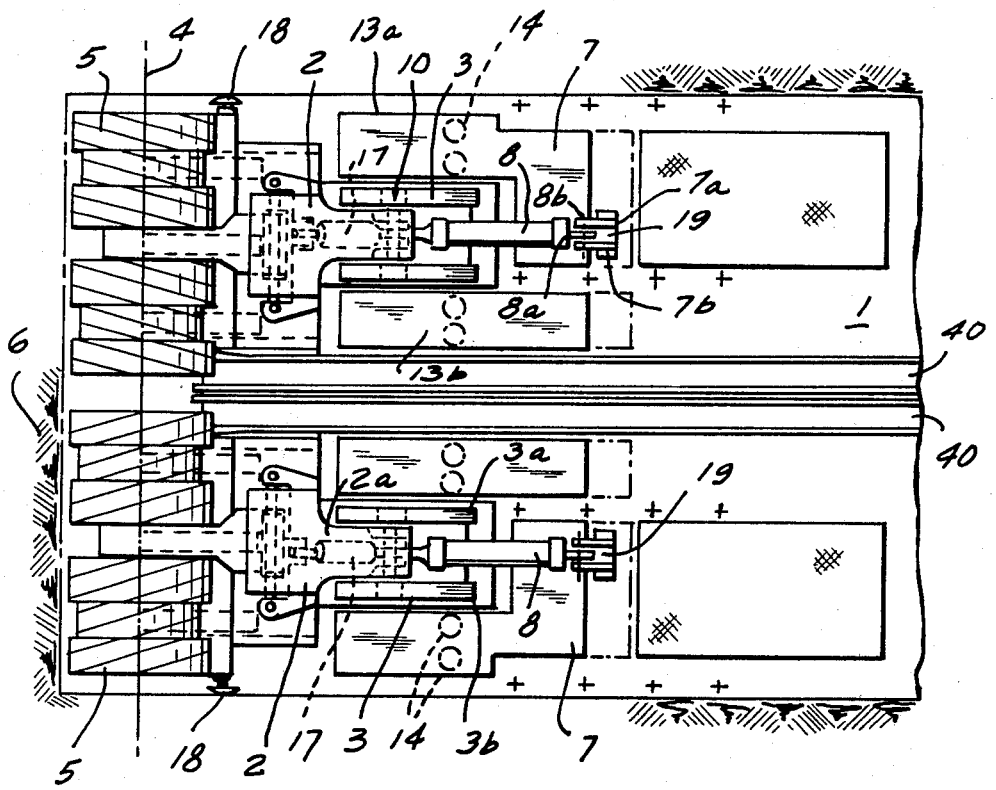
FIG. 2

FIG. 3
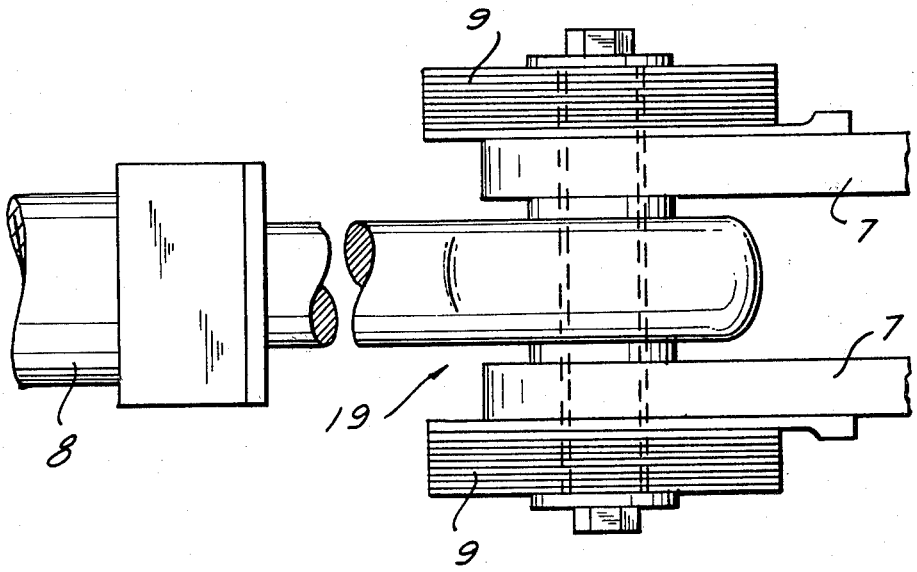
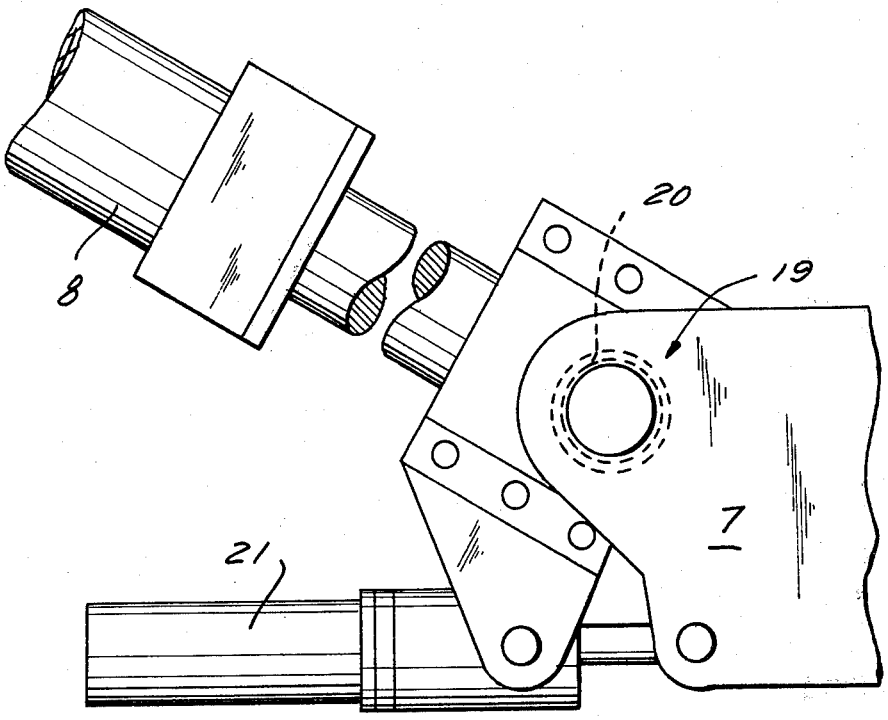
FIG. 4

TUNNEL-EXCAVATING MACHINE

FIELD OF THE INVENTION

The present invention relates to a tunnel-excavating machine and, more particularly, to an excavator for subterranean courses in the production of tunnels and the like.

BACKGROUND OF THE INVENTION

In German Printed Application (Auslegeschrift) DT-AS 25 43 501, there is described a tracked vehicle for the excavation of subterranean courses in the production of tunnels and the like which comprises a forwardly extending machine beam having one or more excavating drums which generally are intended to cut the face of the subterranean structure along the bottom of the excavation to be produced therein. In addition, the vehicle carries an outrigger excavator which can cut upper portions of the face. The milling or cutting head on this arm, which is swingable about a vertical axis and can be raised and lowered with respect to a horizontal axis, is rotated, in turn, about an axis of rotation which generally extends in the direction of advance of the vehicle.

While this apparatus has been found to be highly effective with respect to a highly stable subterranean structure, problems are encountered when the structure is not highly stable and timbering is required proximal to the cutting operation. While the vehicle is generally provided with means for timbering or affording roof support immediately downstream of the beam and vehicle structure, this does not always suffice.

There is also known a tunnel-excavating machine, generally referred to as a DEMAG apparatus, which is provided with an outrigger arm having an excavating head without the aforementioned excavating drum for undercutting the face to be excavated. In this apparatus, however, means is provided for supporting the roof of the excavation and such means includes a cantilevered cap which reaches forwardly close to the cutting operation. Such apparatus can be used in less stable structures but it has been found that problems are encountered primarily with respect to the transfer of vibration to the roof-supporting unit. As a consequence, high-frequency oscillations can develop in the machine which can approach the characteristic or resonance vibration frequency thereof and endanger the tunnel-excavating operation as well as the machine itself. Particularly massive support units are required to brace the machine against these vibration phenomena.

OBJECT OF THE INVENTION

It is the principal object of the present invention to provide an improved tunnel-excavating machine which has the advantages of both types of apparatus described but is free from the disadvantages thereof.

SUMMARY OF THE INVENTION

This object and others which will become apparent hereinafter are attained in accordance with the present invention by providing a chassis which is displaceable in the direction of the face to be excavated and is followed by a roof-support or timbering structure which can be braced against the roof and floor of the tunnel. This support structure can be of the type referred to as a shielding timbering. In other words, the roof-support structure can have a cantilevered and forwardly extending roof-engaging cap which is braced against skids or the like by a plurality of posts which can be hydraulically operated.

In accordance with the present invention, the displaceable chassis and the roof-support unit are connected only by a hydraulic cylinder arrangement, i.e. a fluid-pressure piston-and-cylinder assembly which can be used to shift the chassis forwardly relative to the roof-support structure or, conversely, to draw the roof support structure after the chassis. This cylinder arrangement is provided with vibration-damping means in accordance with an essential feature of the present invention.

According to a feature of the invention, the cylinder arrangement is articulated to both the chassis and the roof-support unit, one or both of these articulations being provided with vibration-damping means. The vibration-damping means can be disposed at the hinge joint and can include metal/rubber or other vibration-damping sleeves of the hinge joint, metal/rubber laminate disks connected to the cylinder arrangement, its hinge and/or the roof-support unit or chassis, or a conventional dashpot-type shock absorber bridging the hinge joint.

The system described above affords the significant advantage that there is no rigid connection between the displaceable frame or chassis and the roof-support frame or unit to transmit oscillations or vibrations between them. As a result, vibrations generated by the excavating head or drum are not transmitted to the roof-support unit. The roof-support unit can serve directly as the bracing against which the cylinder unit reacts to advance the chassis and the cutting tool.

According to an important feature of the invention, the entire face of the tunnel can be excavated with the apparatus, not only the foot of this face, when the excavating tool comprises an excavating drum mounted upon a beam which can be swung upwardly and downwardly upon the chassis and, preferably, can be advanced in the direction of this face relative to the chassis.

It has been found to be advantageous, in this connection, to provide the machine frame or chassis with supporting skids which can be advanced in the direction of the face and are thus disposed immediately behind the cutting drums.

The cutting drums, in addition, can be subdivided into a plurality of drum sections which can be interconnected by universal joints and can be individually and relatively inclined to the horizontal and/or vertical. Thus, when the drum's sections are inclined successively from lower positions to upper positions, gradually the entire face of the subterranean structure can be excavated without putting undue strain on the drive motor for the drum.

In addition, the drums can be provided with cutting teeth of helical configuration so that the drums not only act as excavating or milling cutters but also as conveyors for displacing the detritus laterally to longitudinal conveyors which carry the detritus out of the cutting zone.

The support of the cantilevered roof-support elements can be effected by posts or the like which can be mounted upon skids of the roof-support structure, these skids riding on the floor of the tunnel. The cantilevered elements can be connected to the skids by an articulation as well.

It should be understood that the vibration dampers can be any conventional means provided at the locations indicated, namely, the hinge joints or universal joints interconnecting the roof-support frame with the cutter-carrying frame. Thus any shock-damping or vibration-damping visco-elastic unit can be provided for this purpose. Such materials can be elastomers and the like.

Advantageously, the cylinder arrangement can be inclined to the horizontal and can be hinged to one of these frames by a Hooke's joint bridged by the aforementioned dashpot-type shock absorber or the like.

Not only does the apparatus prevent the transfer of vibration in the manner described, but it also allows at least the advance of the excavation process without manually emplaced timbering directly behind the excavating drum. Because the vibrations are not transmitted to the roof of the tunnel which has been excavated, the latter remains more stable and a cleaner tunneling operation is ensured with greater safety.

BRIEF DESCRIPTION OF THE DRAWING

The above and other objects, features and advantages of the present invention will become more readily apparent from the following description, reference being made to the accompanying drawing in which:

FIG. 1 is a diagrammatic side-elevational view of a portion of the tunnel-excavating machine of the present invention;

FIG. 2 is a plan view thereof with portions of the roof-supporting structure removed;

FIG. 3 is a detail view showing the vibration dampers of the present invention;

FIG. 4 is a detail view of another embodiment of the portion of the device shown in FIG. 3.

SPECIFIC DESCRIPTION

Figure 5:
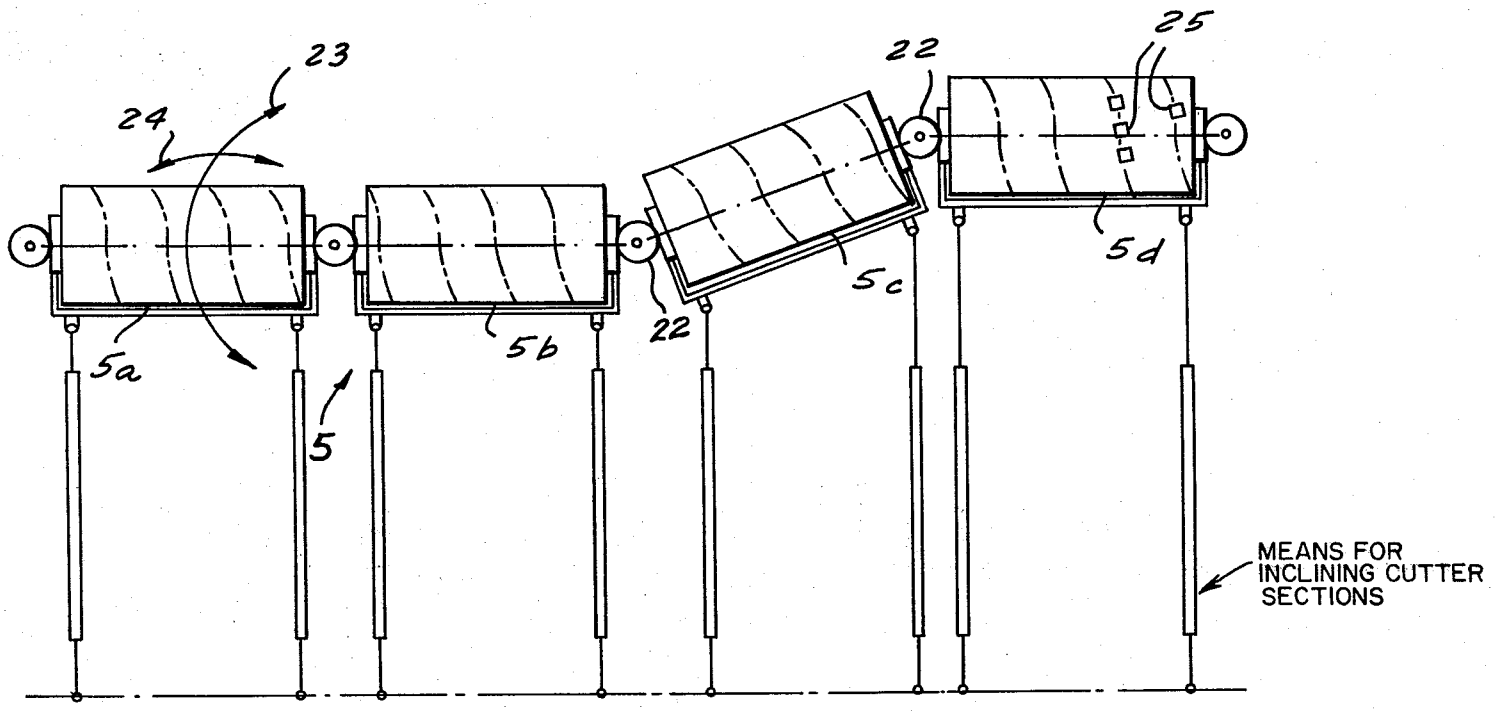
FIG. 5 is a diagrammatic front view of the excavating drums in accordance with the invention.

The tunnel-excavating machine shown in the drawing is especially adapted for use in the formation of tunnels in subterranean-rock structures, one such tunnel being represented at 1 upstream of the machine.

According to the invention, the machine comprises a chassis 3 which can be propelled by a tracked vehicle of the type described in the German printed application (Auslegeschrift) mentioned previously. Only the parts of the structure important to the present invention have been illustrated in the drawing and are described below.

The self-propelled chassis 3, which can be carried at the front end of a vehicle provided with the necessary drive engines, carries a pair of machine beams 2 which can be driven forwardly in the direction of the rock face 6 to be excavated.

The machine beams 2 carry, in the embodiment illustrated, a multipartite excavating drum 5 rotatable about a horizontal axis 4 which lies more or less parallel to the face 6.

The excavating machine is also provided, rearwardly of the chassis 3, with a roof-support unit 7. The roof-support unit 7 has two relatively displaceable roof-support frames which will be described in greater detail hereinafter and overhang the chassis 3.

The chassis 3 is connected with the roof-support unit 7 only by hydraulic advancing and retracting cylinder units 8 which are provided with respective vibration or oscillation dampers represented generally at 9.

The beams 2 can either be rigid with the chassis 3 or can be mounted on the chassis 3 so as to telescope inwardly and outwardly.

In a preferred embodiment of the invention, the beams 2 are swingable about a horizontal axis 10 upon the chassis 3.

The chassis 3 is provided, in the region of the driven excavating drums 5, with forwardly displaceable support runners or skids 11. In addition, the roof-support unit 7 is provided with cantilevered hoods or caps 12 which can be displaced forwardly to a region directly above the driven excavating drums so as to timber or support the roof of the tunnel in the portions thereof last excavated by the drum.

The support unit 7 thus comprises lower or load-supporting skids 13, post-like elements 14, and the aforementioned cantilevered caps or overhanging roof-engaging elements 12. An articulation 15 is provided between the skids and thr roof-engaging elements 12 so that the support elements 12 can be placed under stress against the roof structure 16 of the tunnel.

It is self-understood, and has also been mentioned previously, that the machine also includes all of the necessary drive or control elements necessary to operate the hydraulic devices.

Thus, the drawing shows a drive 17 for the swingable movement of the beams 2 about their horizontal axis 10 to raise and lower the excavating drums 5 between the dot-dash position and the solid line position illustrated in FIG. 1. The hydraulic cylinders 17 are articulated to the chassis 3 and are pivotally connected to the beams 2 at their piston rods.

The drums 5 are provided with respective motors, not shown, and can be rotated. These drums may have helical excavating teeth such that, in addition to milling the wall of the rock structure ahead of the machine, they conduct the detritus inwardly, i.e. to the vertical median plane through the apparatus and a conveyor which carries the detritus away along this median plane. This conveyor is of conventional construction and need not be described in greater detail.

The advancing and retracting cylinders 8, which drive the chassis 3 forwardly relative to the roof-support units 7 which brace against the floor and roof of the previously excavated tunnel portions will, however, be described in greater detail.

These cylinders not only serve to advance and support the chassis 3, but are also constructed so that they are able to hold back the chassis 3 when this is required for any particular application. The reaction force is thus applied to the roof-support unit 7. Conversely, the cylinder arrangements 8 can be operated to draw the roof-support braces 7 toward the chassis 3 when the chassis is itself braced against the lateral walls of the tunnel by the hydraulically actuated or mechanically displaced laterally spreadable elements 18 best seen in FIG. 2.

Naturally, other means can be provided to brace the chassis 3 when the roof-support structure 7 is to be drawn toward the latter.

The combination of the hydraulic cylinder arrangements 8 with vibration and oscillation dampers 9 has been found to be of great importance and, in most cases, essential to the apparatus of the present invention.

In FIG. 3, for example, it will be apparent that the cylinders 8 are connected by hinge eyes to the support unit 7 at pivot joints represented generally at 19 and having horizontal axes. In the embodiment of FIG. 3, the joints 19 are provided with vibration dampers 9 in the form of rubber-metal laminate washers.

In the embodiment of FIG. 4, the oscillation damping 19 is provided in a construction in which the cylinders 8 are disposed with a forwardly inclined and somewhat upward orientation. The pivotal linkage between the support units 7 and the cylinders 8 can be universal or Cardan or Hooke's joints if desired. In this case, dash-pot-type oscillation dampers 21 are provided between the units 7 and the joint which can also be provided with bushings 2- or the like designed to limit the torsional stress and provide an oscillation-damping effect (i.e. a torsion-braking and oscillation-braking pivot lining). These bushings may also be of the metal/rubber type.

The embodiments of either FIG. 3 or FIG. 4 ensure that the roof-support structure 7 will be maintained practically vibration-free and that the vibrations generated upon excavation of the rock structure and transmitted to the chassis 3 will not, in turn, be delivered to the roof support units 7.

This construction permits the oscillating mass represented by the chassis 3, the beams 2 and the excavating drums 5 on the one hand and the mass represented by the support frame 7 on the other hand to be separated by elastic means such that the characteristic elastic constants of the total system will not permit the entire machine to be set into characteristic oscillation or vibration. In other words, sympathetic vibration of the entire apparatus is damped by the elastic and shock-absorbing connection between the two masses of the machine.

Even if the operation of the excavating drums 5 imparts a characteristic vibration to the mass 3, 2, 5, this oscillation is partly damped at 9 and is not transmitted to the roof-support structure 7 to cause it to vibrate in its characteristic vibration mode.

As can be ssen from FIG. 5, the excavating drum 5 can comprise four drum sections 5*a*, 5*b*, 5*c* and 5*d* which are connected together by torque-transmitting universal joints 22 and thus can be relatively inclined with respect to one another in horizontal and vertical directions as represented by the arrows 23 and 24. The relative inclination between the axes of these sections can be between 5° and 50°.

In a preferred embodiment of the invention, the sections are displaced one after the other relative to the horizontal or vertical with an inclination so that the spikes or teeth 25 progressively bite through the rock structure, thereby preventing the entire cutting surface of the drum from having to be effective simultaneously and thereby overloading the drum drive. The teeth 25 are, of course, oriented to provide a screw-type displacement of the detritus to the center of the unit at which a conveyor is provided.

Referring again to FIG. 11, it will be apparent that the roof-support unit 7 comprises, upstanding from the skid 13 which can have a pair of skid runners 13*a* and 13*b* for each of the roof-support units 7, trunnions 7*a* and 7*b* between which the eye 8*a* of the cylinder 8 is pivoted for swinging movement about the axis 8*b*. The trunnions 7*a* and 7*b* are carried on a bracket 7*d* of an upstanding arm 7*e* which is articulated at 15 to an upwardly and forwardly inclined arm 7*f* to which the caps 12*a* and 12*b* forming the cantilevered roof-support elements 12 are connected. The positions of the cylinders 14 have been shown in dot-dash lines in FIG. 1 and it may be seen that two such cylinders are disposed on each of the skid members 13*a* and 13*b* to press against the cantilevered roof-support elements 12*a* and 12*b* which have not been shown in FIG. 2.

The skid 11 of the chassis 3 has a pair of upstanding trunnions 3*a* and 3*b* which are connected by the pivot 10 to the arm 2*a* of the machine beam 2 which carries the respective drums 5. The skids 11 can be formed with the cylinders 18 serving for lateral support.

In operation, assuming the position of the apparatus illustrated in FIG. 1, in which the hydraulic cylinder posts 14 are pressurized to urge the roof-support elements 12 against the roof 16 of the tunnel and the skid 13 against the floor thereof, the cylinders 18 are relieved and the cylinders 8 are pressurized while the drums 5 are driven. Each of the drums 5, if they are in the configuration illustrated in FIG. 5, is progressively swept from the lower position shown at the left into the upper position shown at the right until the entire drum is in the dot-dash position shown in FIG. 1. The drum is then lowered, thereby displacing the detritus inwardly to the conveyors 40 shown in FIG. 2, these conveyors carrying away the detritus. During this process, the chassis 3 has been advanced to the left relative to the roof-support unit 7. Upon the full excursion of the piston rods 8*c* of each of the cylinders 8, the cylinders 18 are actuated to support the chassis 3 against the lateral walls of the tunnel. The posts 14 are relieved and cylinders 8 are drained or reversely pressurized to draw the units 7 to the left to follow the chassis 3. The posts 14 are repressurized to again support the roof in this region, whereupon the process is repeated to further advance the unit along the stretch of tunnel. Timbering pieces 41 can be carried by the machine so that they can be propped in place by posts 42 behind the apparatus for tunnel timbering in the usual manner.

Aspects of the operation of the drums and conveyor will be apparent from the aforementioned printed German application (Auslegeschrift).

I claim:

1. A tunneling machine comprising:

a chassis displaceable along a stretch of tunnel to be excavated in a subterranean structure toward a face thereof to be cut away;

at least one beam mounted on said chassis and extending in the direction of said face;

cutting means on said beam engageable with said face for excavating same;

a roof support unit disposed rearwardly of said chassis and adapted to brace against the roof and floor of the tunnel behind said chassis;

a fluid-pressure cylinder arrangement interconnecting said roof support unit and said chassis as the sole means interconnecting same for relatively displacing said chassis and said roof support unit along said tunnel, said beam being displaceable relative to said chassis toward and away from said face; and means for swingably mounting said beam on said chassis about a horizontal axis, said chassis being provided in the region of said cutting means with forwardly displaceable support skids riding on the floor of said tunnel, said cutting means including at least one cutting drum journaled on said beam for rotation about an axis substantially parallel to said face, said roof support unit comprising a roof-engaging cantilevered cap overhanging said chassis, said drum comprising a plurality of drum sections interconnected by respective universal joints and inclinable relative to one another.

2. The excavator defined in claim 1 wherein said sections are inclinable to the horizontal or vertical through an angle of 5° to 50°.

3. The excavator defined in claim 1 wherein said sections are inclinable one after the other relative to the horizontal or vertical.

4. The excavator defined in claim 1, further comprising oscillation damper means interconnecting said cylinder arrangement with one of said chassis and said unit.

5. The excavator defined in claim 4 wherein said cylinder arrangement is inclined to the horizontal and said vibration damper is formed as a torsion-braking and oscillation-braking pivot lining for a pivot of said cylinder arrangement.

6. The excavator defined in claim 11, further comprising a pivot link connecting said cylinder arrangement with one of said chassis and said unit, said vibration damper including a dashpot shock absorber bridging said pivot link.

* * * * *